US006109090A

United States Patent [19]

Perazzolo

[11] Patent Number: 6,109,090

[45] Date of Patent: Aug. 29, 2000

[54] MACHINE FOR WORKING SHEET METAL

[75] Inventor: Eugenio Perazzolo, Rovico, Italy

[73] Assignee: Rainer S.R.L., Calderara DI Reno, Italy

[21] Appl. No.: 09/119,322

[22] Filed: Jul. 20, 1998

[30] Foreign Application Priority Data

Jul. 22, 1997 [IT] Italy ..... BO97A0444

[51] Int. Cl.[7] ..... B21D 28/20; B21D 28/36

[52] U.S. Cl. ..... 72/442; 72/446; 83/552

[58] Field of Search ..... 72/442, 446; 83/552, 83/571, 813 R

[56] References Cited

U.S. PATENT DOCUMENTS

| | | | |
|---|---|---|---|
| 4,285,259 | 8/1981 | Jelinek et al. | 83/552 |
| 5,072,620 | 12/1991 | Hill et al. | 72/442 |
| 5,848,563 | 12/1998 | Saito | 83/552 |
| 5,934,165 | 8/1999 | Chatham | 83/552 |

FOREIGN PATENT DOCUMENTS

| | | | |
|---|---|---|---|
| 563444 | 10/1993 | European Pat. Off. | 72/442 |
| 58-53333 | 3/1983 | Japan | 72/442 |
| 6-31355 | 2/1994 | Japan | 83/552 |
| 1378183 | 12/1974 | United Kingdom . | |
| 2030498 | 4/1980 | United Kingdom . | |
| 9103335 | 3/1991 | WIPO . | |

*Primary Examiner*—David Jones
*Attorney, Agent, or Firm*—Ladas & Parry

[57] ABSTRACT

The machine comprises a work surface on which sheet metal rests, a fixed structure which supports the work surface, a work station provided with a hammer movable along a vertical axis to punch the sheet metal, punch units defined by a first holder and a punch tool, and die units defined by a second holder and a die tool. The machine includes a first rotatable table which carries the punch units and which transfers a punch unit to the work station, and a second rotatable table which carries the die units and which transfers a die unit to the work station. It includes a first structure for centering the punch unit with respect to the axis by securing the first holder to the fixed structure and means for centering the die unit with respect to the axis by securing the second holder to the fixed structure, excluding the tables from this securing which are therefore not affected by the mechanical stresses generated during punching, which are transmitted by the centering structure directly to the fixed structure.

22 Claims, 3 Drawing Sheets

Fig.1a
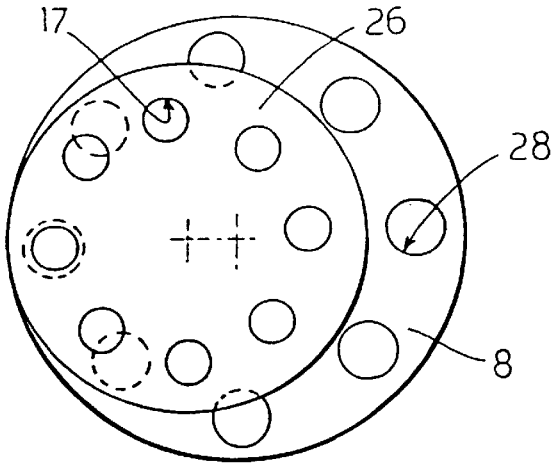
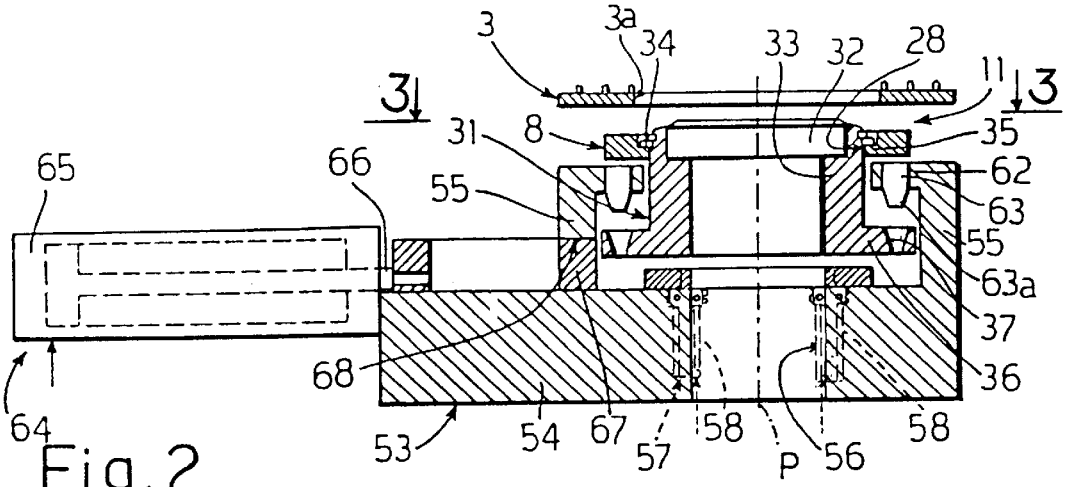
Fig.2
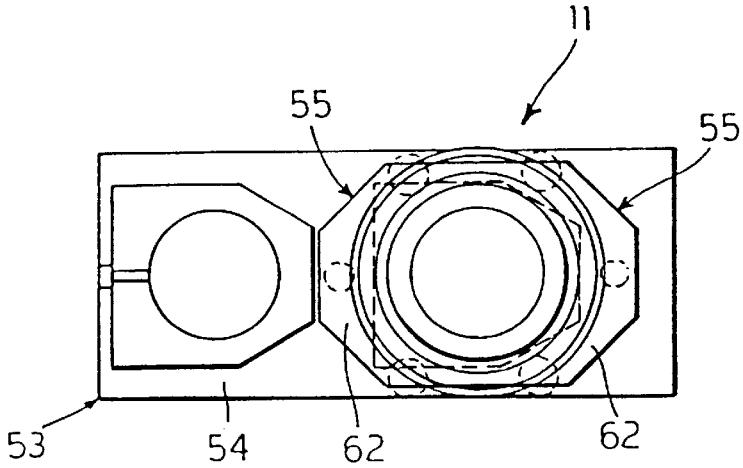
Fig.3

MACHINE FOR WORKING SHEET METAL

BACKGROUND OF THE INVENTION

The present invention concerns a machine for working sheet metal.

As is known, machines for working sheet metal essentially comprise a work surface, a work station, and an element for moving the sheet metal on the work surface to and from the work station. The work station comprises an upper turret supporting a plurality of punch tools, a lower turret supporting a plurality of die tools, and a hammer which presses a punch tool towards a corresponding die tool. The machine described above is further provided with a central electronic processing unit which automatically manages the entire processing cycle.

In use, the punching stage involves:

rotating the upper turret to bring the punch tool to be used into alignment with the hammer;

rotating the lower turret to bring the die tool corresponding to the aforesaid punch tool into alignment with the hammer;

securing both turrets to a fixed structure; and controlling the stroke of the hammer.

The machine described above has several disadvantages. In particular, the turrets are used both for transferring the tools to the work zone and for centering the tools with respect to the work axis of the hammer. In order to transfer the tools, the turrets must be rotatable about a vertical axis and they must be supported by a fixed structure by means of bearings. In order to center the tools, both of the turrets must be joined to the fixed structure and, since the turrets are circular, they must be locked from several radial directions. Furthermore, the turrets must be formed from a highly resilient material and must be appropriately dimensioned as they must withstand the mechanical stresses transmitted from the tools during the punching stage. It is clear that the aforesaid bearings must also be appropriately dimensioned since the mechanical stresses are also transmitted to them during the punching stage.

In short, the fact that the turrets have a dual function (transferring and centering the tools), they must be produced from mechanically valuable materials and be of large dimensions in order to withstand the mechanical stresses, they must be provided with a series of devices to enable the rotation and centering of the tools, and must be subjected to special processing in order to perform the aforesaid functions. Among the special processing to be considered are the seats for the tools, which must be extremely precise, and the shape of the upper surface of the lower turret which acts as the work surface in that the sheet metal to be processed lies on this surface.

It should be emphasized that as the dimensions of the turret increase, the more powerful, and therefore more costly, the means for motorizing the turrets themselves must be. In short, the aforesaid turrets are the elements of the machine on which the greatest and most costly processing must be performed, and these turrets therefore have high production and installation costs. In some machines, in order to protect the lower turret and the elements with which it is provided from wear caused by the aforesaid mechanical stresses, dampening means are installed between this lower turret and the fixed structure, which increases costs and involves further processing of the lower turret.

SUMMARY OF THE INVENTION

The object of the present invention is to produce a machine for working sheet metal that is free from the disadvantages discussed above.

According to the present invention, there is provided a machine for working sheet metal of the type comprising:

a work surface on which lies sheet metal;

a fixed structure that supports the said work surface;

a work station provided with a hammer movable along a first vertical axis along which the punching of the said sheet metal is effected;

a plurality of punch units, each having a first holder and a punch tool;

a plurality of die units, each having a second holder and a die tool;

characterized in that it includes a first rotatable table in which the said punch units are stored, which transfers one said punch unit to the said work station, a second rotatable table in which the said die units are stored, which transfers one said die unit to the said work station, and characterized in that the said work station comprises first means for centring the said punch unit with respect to the first vertical axis by securing the said first holder to the said fixed structure, and second means for centering the said die unit with respect to the said first axis by securing the said second holder to the said fixed structure, excluding the said tables from this securing, which tables are therefore not affected by the mechanical stresses generated by the punching, stresses that are transmitted directly from the first and second centering means to the said fixed structure.

BRIEF DESCRIPTION OF THE DRAWINGS

The present invention will now be described with reference to the accompanying drawings in which:

FIG. 1*a* is a plan view of two elements of the machine of FIG. 1;

FIG. 2 is a view of an element of the machine of FIG. 1 in a particular operational position;

FIG. 3 is a sectional view taken on line III—III in FIG. 2;

DETAILED DESCRIPTION OF THE INVENTION

Figure 1:
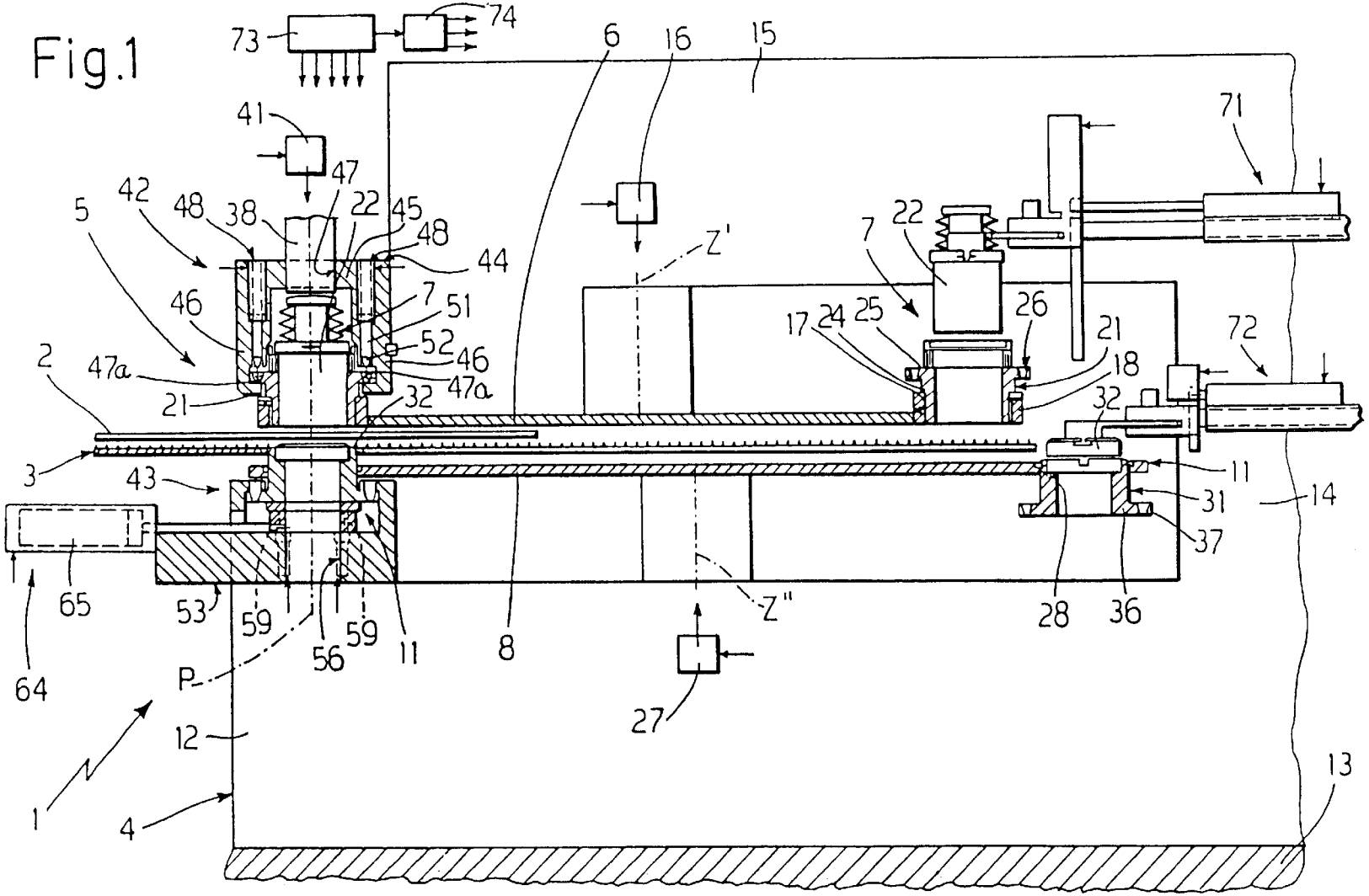
FIG. 1 is a side view in partial section of a machine for working sheet metal, produced according to the present invention.

With reference to FIG. 1, the reference numeral 1 generally indicates a machine for working sheet metal 2, produced according to the present invention. The machine 1 comprises a work surface 3 of known type, a fixed structure 4 that supports the work surface 3 in a way that is not illustrated, a work station in which the sheet metal 2 is punched, an element (not illustrated as it is of known type) for moving the sheet metal 2 on the work surface 3 to and from the work station 5, a first rotatable table 6 in which a plurality of punch units 7 are stored, and a second rotatable table 8 in which a plurality of die units 11 are stored. The tables 6 and 8 lie in respective horizontal planes, and the table 6 is at a higher level than the table 8.

In the example illustrated in FIG. 1, the fixed structure 4 is of the swan-neck type and includes a base 12 resting on a floor 13 and supporting the work surface 3 in a way that is not shown, a vertical column 14 extending upwards from the base 12 at a peripheral zone of the base 12 itself, and a frame 15 carried by the column 14 and extending higher than and parallel to the base 12. The work surface 3 extends into the fixed structure 4 between the base 12 and the frame 15 until it is close to the column 14.

With reference to FIGS. 1 and 1*a*, the table 6 is defined by a disc adapted to rotate, by means of motorization means 16, about a vertical axis Z'. A plurality of vertical through-holes 17 are formed along the peripheral rim of the table 6, each of which is engaged by a cylindrical sleeve 18 having a vertical longitudinal axis. Preferably, the sleeves 18 are welded to the table 6. The lower edges of the sleeves 18 are in edge-to-edge contact with the lower surface of the table 6, and their upper edges are higher than the upper edge of the table 6. The sleeves 18 form respective seats for housing the punch units 7.

With reference to FIG. 1, each punch unit 7 includes a holder 21 housed in the corresponding sleeve 18, and a punch tool 22 housed in the corresponding holder 21. As will be seen better below, the punch unit 22 is removable from the corresponding holder 21 in order to be able to change over the tool, the holder 21 remaining in the sleeve 18. The holder 21 is defined by a tubular body having a central outer annular shoulder 24 which rests on the upper edge of the sleeve 18 and, at its upper edge, an annular flange 25 in which two vertical through-holes 26 are formed, having a truncated cone-like shape in which the diameter decreases from the top downwards.

With reference to FIGS. 1 and 1*a*, the table 8 is defined by a disc that is rotatable, by means of motorization means 27, about a vertical axis Z" which is at a predetermined distance from the axis Z'. The diameter of the table 8 is greater than that of the table 6 and the projection of the table 6 on the table 8 remains within the perimetral edge of the table 8 itself. Consequently, the table 8 has a zone outside the perimeter of the table 6 and it is possible to change over the tools at this uncovered zone on the table 8. The table 8 has a plurality of vertical through-holes 28 along a peripheral rim, which constitute the seats for housing the die tools 11.

With reference to FIGS. 1 and 2, each die unit 11 includes a holder 31 housed in the corresponding hole 28, and a die tool 32 housed in the corresponding holder 31. The die tool 32 is removable from the holder 31 in order to effect the tool changeover, the holder 31 remaining in the hole 28. The holder 31 is defined by a tubular body having an inner annular shoulder 33 on which the die unit 32 rests; the upper edge of the die tool 32 being slightly higher than the upper edge of the holder 31. Close to the upper edge of the holder 31 is a ring 34, carried firmly on the outside thereof, by means of which it rests on an annular shoulder 35 formed within the corresponding hole 28; the upper edge of the holder 31 being slightly higher than the upper edge of the hole 28 when the die unit 11 is in a rest position. Finally, the holder 31 has an outer annular flange 36 at its lower edge, in which are formed two vertical through-holes that are truncated cone-like in shape with the diameter decreasing from the top downwards; the aforesaid flange 36 being at a lower level than the table 8. In the rest position, the upper edge of the die unit 11 is lower than the work surface 3.

With reference to FIG. 1, the work station 5 comprises a hammer 38 translatable along a vertical axis P in order to perform the punching stage which consists of pressing the punch tool 22 against the die tool 32 through a vertical through-hole 3*a* formed in the work surface 3, and thus punching the sheet metal 2 resting on the work surface 3. The translation of the hammer 38 along the axis P is controlled by translation means 41, preferably of the oleodynamic type. The diameter of the tables 6 and 8 and their relative position defines (FIGS. 1 and 1*a*) a coaxiality at the axis P with respect to that of a sleeve 18, the hole 3*a* and a hole 28 and, therefore, the coaxiality between the hammer 38 and a punch tool 22 and a die tool 32.

With reference to FIG. 1, the work station 5 further includes means 42 for centering the holder 21 with respect to the axis P, and means 43 for centering the holder 31 with respect to the axis P. The means 42 enter into play when the holder 21 is coaxial with the axis P and secures the holder 21 to the frame 15. The means 43 enter into play when the holder 31 is coaxial with the axis P and secures the holder 31 to the base 12. During the securing of the holders 21 and 31, respectively, to the frame 15 and the base 12, the tables 6 and 8 are not affected in that the holders 21 and 31 are taken by other bodies, as will be described below. In summary, the sole function of the tables 6 and 8 is to transfer the punch unit 7 and the die unit 11 to the work station 5.

With reference to FIG. 1, the centering means 42 comprise a reverse U-shape body 44 fixed to the frame 15 outside the space defined between the frame 15 and the base 12. When the punch unit 7 is transferred to the work station 5, the upper part of the punch unit 7 is housed within the body 44. This body 44 has a horizontal base wall 45 and two vertical side walls 46. A through-hole 47 is formed in the base wall 45, coaxial with the axis P and through which the hammer 38 extends into the body 44. Both of the side walls 46 have, at their lower ends and on the inner surface of the body 44, a respective slot 47*a* having a horizontal axis. When a punch unit 7 is at the work station 5, the slots 47*a* house opposite parts of the flange 25. In particular, the flange 25 is in abutment on the lower surface that delimits each of the slots 47*a*, and the holes 26 correspond with the slots 47. Finally, for each wall 46, the centering means 42 comprise a fluid dynamic actuator 48 provided with a rod 51 movable along an axis parallel to the axis P, between a retracted position in which the rod 51 remains within the corresponding wall 46, and an extended position in which the rod 51 extends into the corresponding slot 47*a*, engaging a corresponding hole 26 with a truncated cone-shape tip 52.

With reference to FIGS. 1, 2 and 3, the centering means 43 comprise a U-shape body 53 fixed to the base 12 outside the space defined between the frame 15 and the base 12. The body 53 has a horizontal base wall 54 and two vertical side walls 55; these walls 55 describe a circular arc in plan. When the die unit 11 is at the work station 5, the lower part of the die unit 11 is housed within the body 53. The base wall 54 has a through-hole 56 coaxial with the axis P, through which the waste products are channelled towards an outlet, not shown. The diameter of the hole 56 is substantially equal to the inner diameter of the holder 31.

The centering means 43 comprises a device 57 capable of controlling the position of the die unit 11 along the axis P, between a retracted position in which the upper part of the die unit 11 remains at a lower level than the work surface 3, and an extended position in which the upper part of the die unit 11 is at a slightly higher level, through the hole 3*a*, than the work surface 3. The device 57 comprises four fluid dynamic actuators 58 which, with their own rods 59, support an annular disc 61 coaxial with the axis P. The actuators 58 are installed in suitable seats formed in the base wall 4 at the perimetral edge of the hole 56, and the disc 61 is located within the body 53 between the base wall 54 and the lower part of the die unit 11. The inner diameter of the disc 61 is substantially equal to that of the hole 56. The side walls 55 have a respective portion of their upper end 62 bent towards the inside of the body 53 in such a way as to be horizontal. Each portion 62 carries a pin 63 which extends vertically into the body 56 with a truncated cone-shape tip 63*a*.

In use, in the retracted position, the die unit rests on the shoulder 35 of the hole 28, and the disc 61 is at a predetermined distance from the lower part of the die unit 11. In order to control the passage of the die unit 11 from the retracted position to the extended position, it is necessary, by means of the actuators 56, to cause the upward stroke of the disc 61 which, once it has come into contact with the lower part of the die unit, causes the upward stroke of this die unit 11 also until the flange 36 abuts against the portions 62. In this extended position of the die unit 11, the pins 63 engage the holes 37, and the upper part of the die unit 11 projects from the hole 3*a* of the work surface 3.

With reference to FIGS. 1, 2 and 3, the centering means 43 finally includes a device 64 that causes the abutment of the die unit 11 on the base 12 when the die unit 11 is in the extended position, such that the mechanical stresses in play during the punching stage are transmitted to the base 12. The device 64 comprises a fluid dynamic actuator 65 having a horizontal rod 66 which carries a tubular element 67 at a free end, having a vertical axis and an inner diameter substantially equal to that of the disc 61. The actuator 65 is supported by the base wall 54 and, by means of the rod 66, controls the stroke of the element 67 between an extended position in which the element 67 is outside the closed space in the body 53, and an extended position in which the element 67 is coaxial with the axis P through a hole 68 formed in the outermost side wall 55. The element 67 is introduced into the body 53 when the die unit 11 assumes its extended position, and is inserted between the disc 61 and the base wall 54. In particular, the height of the element 67 is substantially equal to the distance between the disc 61 and the base wall 54 when the die unit 11 is in its extended position. In this way, during the punching stage, the die unit 11 abuts against the base 12 across the disc 61, the element 67 and the base wall 54 of the body 3.

The machine 1 further includes means 71 for changing over the punch tools 22, and means 72 for changing over the die tools 32; the means 71 and 72 being described in patent applications filed by the same Applicant. Finally, the machine 1 includes a central electronic processing unit 73 which controls the working cycle and, in particular, controls the motorization means 16 and 27 and which, by means of a fluid dynamic central processing unit 74, controls the translation means 41, the centering means 42 and 43, and the tool changeover means 71 and 72.

The working cycle of the machine 1 is easily understandable from the above description and includes essentially:

- transferring a punch unit 7 and a die unit 11 to the work station 5, this transfer being performed by the tables 6 and 8;
- centering the punch unit 7 and the die unit 11 on the fixed structure 4 which consists in securing the holders 21 and 31 to the fixed structure 4 without any involvement of the tables 6 and 8; and
- punching the sheet metal 2 as described above.

From the above description, the advantages of the present invention are clear and numerous.

In particular, the tables 6 and 8 have the sole and exclusive function of elements for transferring the punch units 7 and the die units 11 to and from the work station 5. Since these tables 6 and 8, in preparation for the punching stage, are not involved in the subsequent securing of the punch units 7 and die units 11, they are not subjected to the mechanical stresses that arise during the punching stage; stresses that will be transmitted to the fixed structure 4 which, as is clear, due to its dimensions and the fact that it is fixed, is able to withstand them. Consequently, the tables 6 and 8 can be produced with a lesser thickness and of a material that is not particularly mechanically resilient. In summary, the tables 6 and 8 do not require special processing in that they only have to transfer the punch and die units 7 and 11 to the work station 5, which are then taken by other elements. All of this further contributes to a better functioning of the machine 1, and a reduction in the wear of the more delicate components of the machine 1, as well as a significant reduction in the production costs thereof.

Finally, it is clear that modifications and variations can be introduced into the machine 1 described and illustrated here without departing from the ambit of protection of the invention.

In particular, the machine 1, instead of the centering means 43, uses centering means 81 which differs from those of FIG. 1 in several aspects. The centering means 81 comprise a U-shape body 82 fixed to the base 12 outside the space defined between the frame 15 and the base 12. The body 82 has a horizontal base wall 83 and two vertical side walls 84. When the die unit 11 is at the work station 5, the lower part of the die unit 11 is housed within the body 82. The base wall 83 has a through-hole 85 coaxial with the axis P through which the waste products of the working are channelled towards an outlet, not shown. The diameter of the hole 85 is substantially equal to the inner diameter of the holder 31.

The centering means 81 is provided with the device 57 described above, so that it is not necessary to repeat the description and the operation thereof. The side walls 84 have a respective upper end portion 86 folded towards the inside of the body 82 in such a way as to be horizontal. The innermost side wall 84 firmly supports a pad 87 having a slot 88 with a vertical axis formed in its face that faces the body 82. The slot 88 describes a circular arc in plan and has a truncated cone-shape portion at its lower end which constitutes an entrance for a pin as will be described below. The outermost side wall 84 supports a pad 91 having a slot 92 similar to the slot 88 formed in its face that faces the pad 87. The holder 31 of the die unit 11, unlike the holder 31 illustrated in FIG. 1, instead of the flange 36, has two semi-cylindrical projections 93 having a vertical axis. The upper part of the projections 93 is defined by a truncated cone-shape portion, and the projections 93 perform the function of pins that engage the slots 88 and 92 when the die unit 11 is in the extended position. The pad 91, by means of a fluid dynamic actuator 94 carried on the outermost side wall 84, is movable between a first position in which it is at a predetermined distance from the holder 31 so that the slot 92 is not engaged by the corresponding projection 93, and a second position in which the slot 92 is engaged by the projection 93. In order to improve the centering, the movement of the pad 91 towards the second position is performed with the die unit 11 already in its extended position.

In use, in the retracted position, the die unit 11 rests on the shoulder 35 of the hole 28, and the disc 61 is at a predetermined distance from the lower part of the die unit 11. In order to control the passage of the die unit 11 from the retracted position to the extended position, it is necessary, by means of the actuators 56, to move the disc 61 upward which, once it comes into contact with the lower part of the die unit 11, causes the die unit 11 to move upward also. In the extended position of the die unit 11, a projection 93 engages the slot 88 of the pad 87. The movement of the pad 91 to complete the centering from the opposite side is then controlled as already described.

Figure 4:
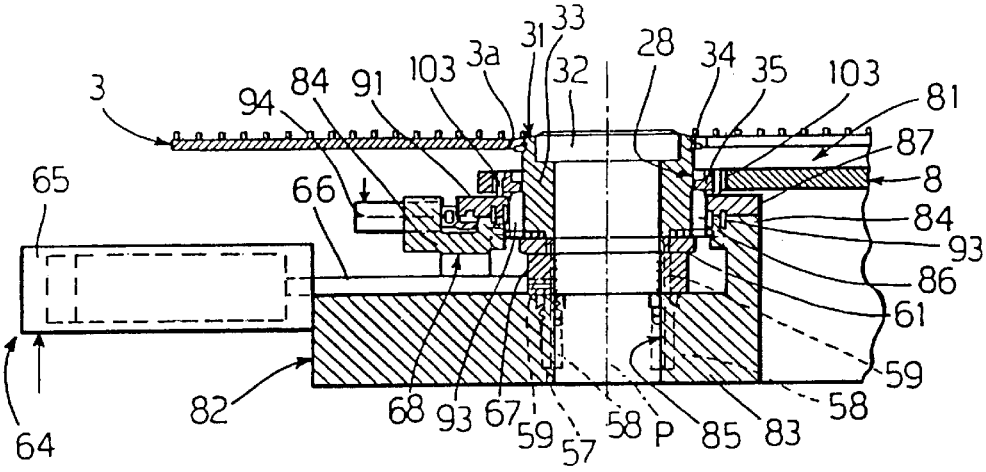
FIGS. 4 and 5 are views in two different operational positions of an element formed differently from that illustrated in FIG. 2.
Figure 5:
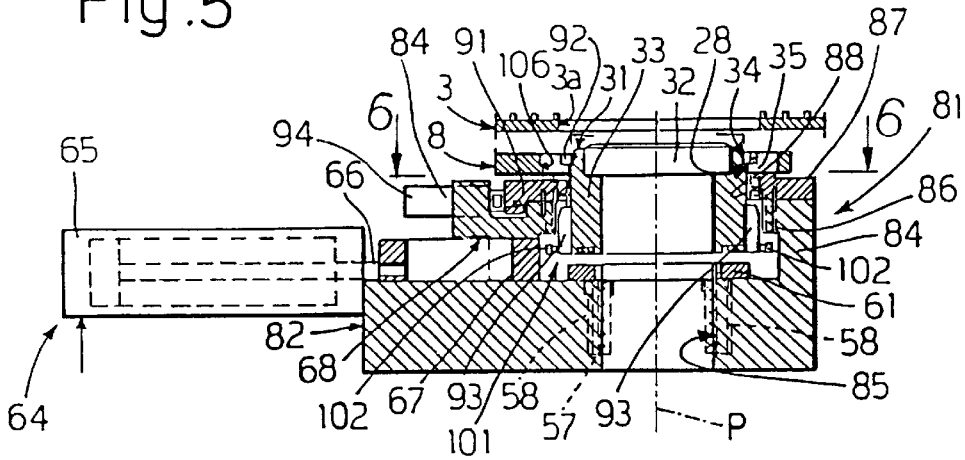
Figure 6:
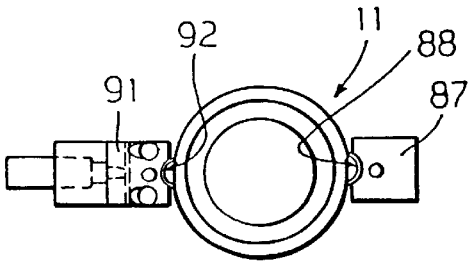
FIG. 6 is a sectional view taken on line VI—VI in FIG. 5.

With reference to FIGS. 4, 5 and 6, the centering means 81 thus comprises the device 64 that is similar to and with the same functions as that illustrated in FIG. 1. Finally, the centering means 81 comprises a device 101 adapted to return the die unit 11 to the rest position once the punching stage has finished and the tubular element 67 has been removed from the body 82. The device 101 includes two screws 102 screwed in diametrically opposed positions to the lower part of the holder 31. In particular, the screws 102 have horizontal axes and have their heads and a significant portion of their shank outside the holder 31. The device 101 further includes two vertical pins 103, each of which is housed in an associated through-seat formed in the portions 86 of the walls 84 and in the corresponding underlying pads 87 and 91. The pins 103 are held in the corresponding seat by means of preloaded spring means and the portion of the seat formed in the portions 86 is open towards the inside of the body 82.

In use, as illustrated in FIG. 4, during the upward stroke of the die unit 11 to assume its extended position, the heads of the screws 102 enter the aforesaid seat and push upwards, against the action of the aforesaid spring means, the pins 103 which, with their heads, leave the respective seats in order to enter suitable slots 106 formed in the hole 28 of the table 8. Once the punching stage has finished and the element 67 removed from the body 82 and the disc 61 taken to the rest position, the spring means, by returning the corresponding pin 103 to its seat, push the screws 102 downwards thus causing the die unit 11 to move to its retracted position.

What is claimed is:

1. A machine for working sheet metal comprising:

a work surface (3) for supporting sheet metal (2) to be punched;

a fixed structure (4) which supports the said work surface (3);

a work station (5) provided with a hammer (38) movable along a first vertical axis (P) along which punching of the said sheet metal (2) occurs;

a plurality of punch units (7), each including a first holder (21) and a punch tool (22);

a plurality of die units (11), each including a second holder (31) and a die tool (32);

a first rotatable table (6) supporting said punch units (7) for transfer to the said work station (5), a second rotatable table (8) supporting said die units (11) for transfer to said work station (5), first means (42) at said work station for centering each said punch unit (7) at said work station with respect to the said first vertical axis (P) by securing the respective said first holder (21) to the said fixed structure (4), and second means (43, 81) at said work station for centering each said die unit (11) with respect to the said first vertical axis (P) by securing the respective said second holder (31) to the said fixed structure (4), and means for punching the sheet metal by applying force to the die and punch tools at said work station, the said tables (6 and 8) being excluded from the securing of the holders to the fixed structure and therefore not being affected by mechanical stresses generated by the punching of the sheet metal, said stresses being transmitted directly from the said first and second centering means (42 and 43) to the said fixed structure (4).

2. A machine according to claim 1, wherein said fixed structure (4) includes a swan-neck element which includes a base (12) resting on a floor (13) and supporting the said work surface (3), a vertical column (14) which extends upwards from the said base (12) at a distance from said work station and a frame (15) carried by the said column (14) and which extends above and parallel to the said base (12); the said work surface (3) extending into the said fixed structure (4) between the said base (12) and the said frame (125) to a position close to the said column (14), the said first centering means (42) securing the said first holder (21) to the said frame (15), and the said second centering means (43, 81) securing the said second holder (31) to the said base (12).

3. A machine according to claim 1, wherein said first table (6) comprises a disc rotatable, by means of first motorization means (16), about a second vertical axis (Z'); a plurality of first seats (17, 18) for housing the said punch units (7) being formed along a peripheral rim of the said first table (6).

4. A machine according to claim 3, wherein said first seats are defined by first holes (17) formed in the said first table (6) and by cylindrical sleeves (18), each having a vertical longitudinal axis and fixed to the said first table (6), each said sleeve having lower edges in edge-to-edge contact with a lower surface of the said first table (6), and upper edges located above an upper surface of the said first table (6).

5. A machine according to claim 4, wherein said first holders (21) are housed in respective said sleeves (18), and each said holder has a first outer annular shoulder (24) which rests on the upper edge of the respective said sleeve (18); the said first holder (21) having, at an upper edge thereof, a first annular flange (25) in which two second vertical through-holes (26) are formed.

6. A machine according to claim 5, wherein said first centering means (42) comprises a first body (44) fixed to the said fixed structure (4) and provided with first vertical pins (51) movable between a retracted position and an extended position in which the pins engage the said second holes 26 with a respective tip (52) thereof.

7. A machine according to claim 6, wherein said tip (52) of each of the said first pins (51) and the said second holes (26) have a truncated cone-like shape.

8. A machine according to claim 6, wherein said first body (44) has a reverse U-shape and houses an upper part of the said punch unit (7) when said punch unit is transferred to the said work station (5); the said first body (44) having a horizontal base wall (45) and two vertical side walls (46).

9. A machine according to claim 8, wherein a third through-hole (47) is formed in the said base wall (45) of the said first body (44), coaxial to the said first vertical axis (P) and through which the said hammer (38) extends into the said first body (44), the said side walls (46) of the said first body (44) have, at an inner surface at lower ends thereof and, a respective first slot) (47*a*) having a horizontal axis; the first slots) (47*a*) housing opposite parts of the said first flange (25) when the said punch unit (7) is at the said work station (5).

10. A machine according to claim 9, wherein said first centering means (42) includes first fluid dynamic actuators (48) for controlling translation of the said first pins (51).

11. A machine according to claim 3, wherein said second table (8) comprises a disc rotatable, by means of a second motorization means (27), about a third vertical axis (Z"); the said second table (8) having a plurality of second seats (28) for housing the said die units (11) along a peripheral rim of said second table.

12. A machine according to claim 11, wherein each said second holder (31) has a second inner annular shoulder (33) on which the respective said die tool (32) is in abutment in such a way that the upper edge of the said die tool (320 is at a slightly higher level than the upper edge of the said second holder (31); the said holder having an external ring close to its upper edge for abutting on a third annular shoulder (35) formed in the corresponding said second seat (28) and the upper edge of the said second holder (31) being, in a rest position of the said die unit (11), slightly above the upper edge of the said second seat (28).

13. A machine according to claim 12, wherein said second centering means (43, 81) comprises a second body (53, 82) attached to the said fixed structure (4), within which is housed a lower part of the said die unit (11), and a first device (57) which controls a position of the said die unit (11) along the said first vertical axis (P) between a retracted position in which the upper part of the said die unit (11) remains at a lower level than the said work surface (3), and an extended position in which the upper part of the said die unit (11) reaches a slightly higher level than the said work surface (3) through a fourth through-hole (3*a*) formed therein; the said second body (53, 82) comprising a base wall (54, 83) and two upwardly extending side walls (55, 84).

14. A machine according to claim 13, wherein said first device (57) comprises a plurality of second fluid dynamic actuators (58) supporting an annular disc (61) coaxial with the said first vertical axis (P) and within the said second body (53, 82); the said disc (61) coming into contact with the said die unit (11) to initiate the translation thereof.

15. A machine according to claim 14, wherein said second centering means (43, 81) comprise a second device (64) which forms an abutment between the said die unit (11) and a portion (12) of the said fixed structure (4) when the said die unit (11) is in the extended position such that the mechanical stresses developed during punching are transmitted to the said fixed structure (4).

16. A machine according to claim 15, wherein that the said second device (64) comprises a third fluid dynamic actuator (65) having a horizontal rod (66) which carries a tubular element (67) at a free end, which tubular element has a vertical axis and an inner diameter substantially equal to that of the said disc (61); the said third actuator (65) controlling movement of the said tubular element (67) between an extended position in which the said tubular element (67) is outside the closed space in the said tubular second body (53, 82), and an extended position in which the said element (67) is coaxial with the said first vertical axis (P) between the said disc (61) and the said base wall (54, 83) which abuts against the said portion (12) of the said fixed structure (4).

17. A machine according to claim 13, wherein said second centering means (43) includes second vertical pins (63) carried by the said side walls (55) of the said second body (53), each pin having a tip (63) for engaging in a respective fourth through-hole (37) formed in a second annular flange (36) on the said second holder (41); the said tip (63*a*) and the said fourth hole (37) being of truncated cone-shape.

18. A machine according to claim 13, wherein said second centering means (81) includes second vertical pins (93) carried on the said second holder (31) and which engage in a respective second slot (88, 92) formed in the said side walls (84) of the said second body (82).

19. A machine according to claim 18, wherein said second centering means (81) comprises a third device (101) which returns the said die unit (11) to its retracted position when the punching has finished and said element (67) has been removed from the said second body (82).

20. A machine according to claim 11, wherein third vertical axis (Z") is at a predetermined distance from the said second vertical axis (Z').

21. A machine according to claim 20, wherein said second table (8) has a larger diameter than the said first table (6).

22. A machine according to claim 1, further comprising means (71) for changing over the said punch tools (22), and means (72) for changing over the said die tools (32).

* * * * *